United States Patent [19]

Jacov

[11] Patent Number: 4,599,839

[45] Date of Patent: Jul. 15, 1986

[54] IMPROVEMENT IN CEILING BLOCKS

[76] Inventor: Snitovski Jacov, 17 Bialik Street, Ramat Hasharon, Israel

[21] Appl. No.: 445,279

[22] Filed: Nov. 29, 1982

[30] Foreign Application Priority Data

Dec. 7, 1981 [IL] Israel ..... 64463

[51] Int. Cl.[4] ..... E04B 5/36

[52] U.S. Cl. ..... 52/309.12; 52/323; 52/405

[58] Field of Search ..... 52/405, 309.4, 309.8, 52/309.12, 220, 323, 384, 385, 596, 604, 606, 612, 577, 576, 593, 809

[56] References Cited

U.S. PATENT DOCUMENTS

| | | | |
|---|---|---|---|
| 1,487,098 | 3/1924 | Goldsmith | 52/323 |
| 1,550,606 | 8/1925 | Dale | 52/323 |
| 3,239,982 | 3/1966 | Nicosia | 52/309.8 |
| 3,318,062 | 5/1967 | Grants | 52/309.12 |
| 3,382,637 | 5/1968 | Longinotti | 52/320 |
| 3,504,470 | 4/1970 | Pincemin | 52/385 |
| 4,096,676 | 6/1978 | Hebert | 52/220 |
| 4,193,241 | 3/1980 | Jensen | 52/309.12 |
| 4,348,845 | 9/1982 | Iannarelli | 52/405 |

FOREIGN PATENT DOCUMENTS

| | | | |
|---|---|---|---|
| 503575 | 6/1951 | Belgium | 52/323 |
| 823507 | 12/1951 | Fed. Rep. of Germany | 52/323 |
| 726439 | 5/1932 | France | 52/323 |
| Ad.72333 | 4/1960 | France | 52/323 |
| 1245853 | 10/1960 | France | 52/323 |
| 1298765 | 6/1962 | France | 52/323 |
| 1357510 | 2/1964 | France | 52/323 |
| 1464438 | 12/1966 | France | 52/577 |
| 2308751 | 11/1976 | France | 52/309.12 |
| 315813 | 10/1956 | Switzerland | 52/323 |
| 722153 | 1/1955 | United Kingdom | 52/323 |
| 1048844 | 11/1966 | United Kingdom | 52/323 |

*Primary Examiner*—John E. Murtagh

*Attorney, Agent, or Firm*—Silverman, Cass & Singer, Ltd.

[57] ABSTRACT

Ceiling block construction comprising cast concrete bottom parts with planar walls and upwardly opening depressions for the selective reception of depending projections integrally formed with foam plastic top parts, providing an interlocking structure. A single top part can be of a size so as to overlay multiple bottom parts with depending projections engaged within the depressions of each of the multiple bottom parts.

5 Claims, 6 Drawing Figures

IMPROVEMENT IN CEILING BLOCKS

The present invention concerns a building block used for ceilings.

It is the object of the present invention, to provide a ceiling block whose weight is as light as possible, which is thermally insulating and which can be finished to provide an attractive ceiling with as little outlay as possible.

It is a further object of the present invention, to provide a ceiling block of light weight, so that when a ceiling is constructed with these blocks, the entire ceiling is comparatively light. Thus, it will be possible to save in supporting columns, reinforcing steel, building material and the like.

The invention consists in a ceiling block having a bottom part cast of concrete or other suitable building material and having at least one depression, the other complementary top part being made of foamed plastic, having at least one integral projection, adapted to be lodged in said depression.

In a preferred embodiment of the invention, the bottom part has at least two depressions, the complementary top part being made of foamed plastic having integral pairs of feet, at least one of each pair adapted to be lodged in a depression.

Whenever concrete is mentioned in the context of this patent application, other suitable building materials such as plaster of Paris, mixtures of silicates, Ytong (T.M.), asbestos, light concrete, concrete mixed with glass fibres or other aggregates, ceramics or the like may be used.

Not only is the weight of a ceiling made with the blocks according to the invention reduced considerably, but the transport and handling of these blocks is much cheaper than with conventional ceiling blocks.

The invention is illustrated, by way of example only, in the accompanying drawings in which.

Figure 1:
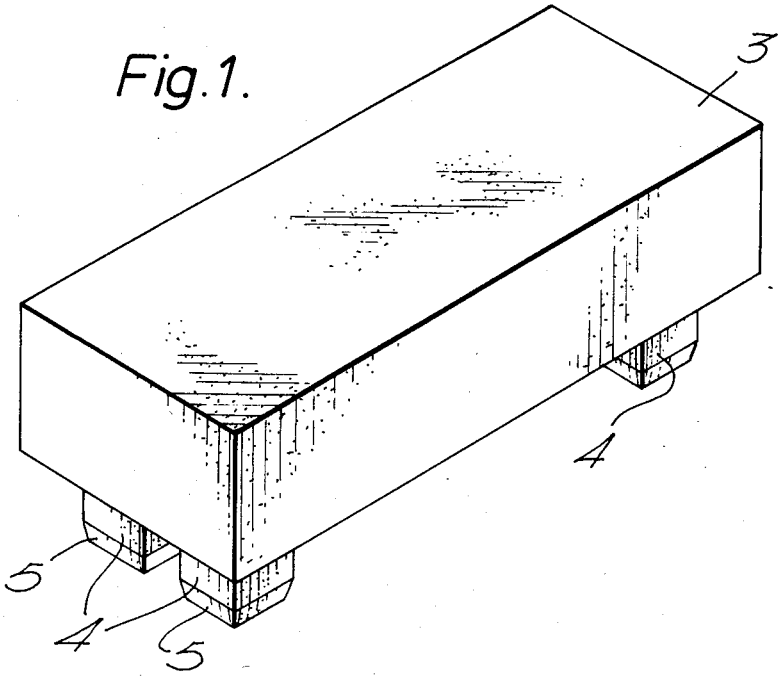
FIGS. 1 and 2 show in perspective view the two parts of a building block according to the invention.
Figure 2:
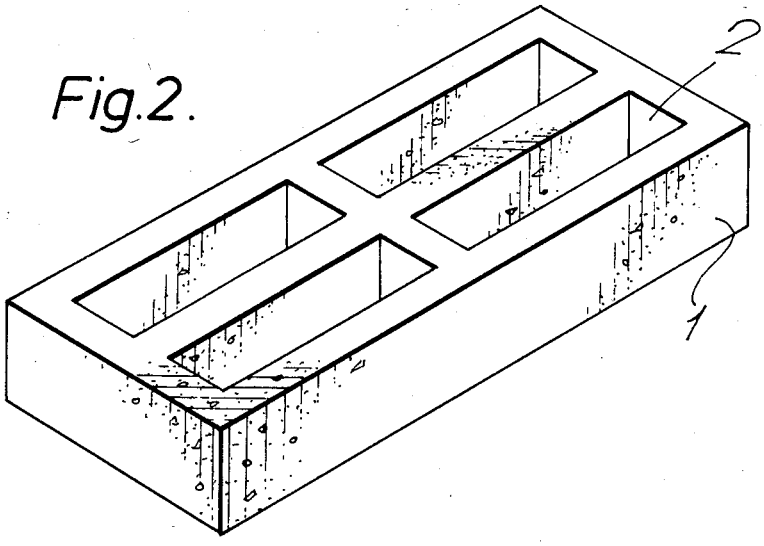
Figure 3:
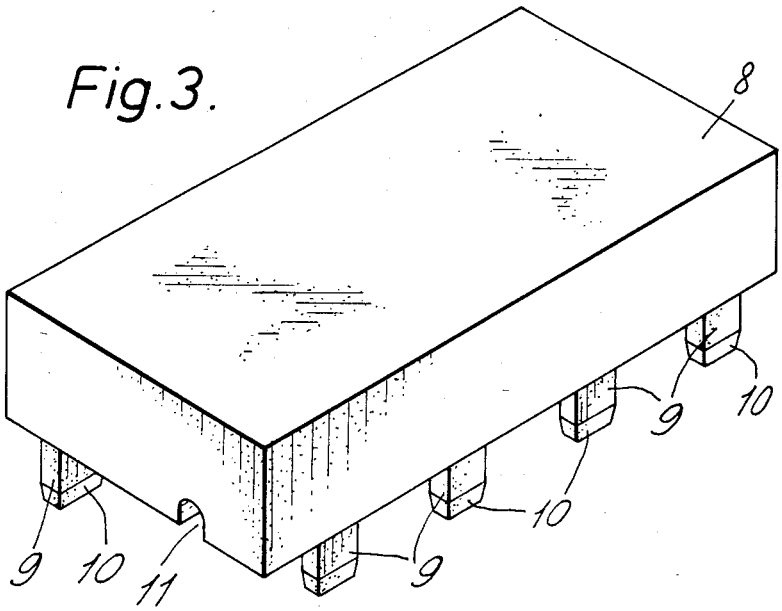
FIGS. 3 and 4 show in a similar view a second embodiment thereof.

The ceiling block may be constructed with a bottom part of concrete having one large depression, and a top part of foamed plastics having a foot or extension adapted to fit into said depression. However, it is preferable, as shown in FIGS. 1 and 2 to construct the building block so that it comprises one part, hereinafter called the bottom part 1, cast of concrete having four rectangular depressions 2 in its top, the depressions 2 being arranged in pairs in both directions and extending to near bottom part 2, whereby its weight is greatly reduced.

The other part of the block hereinafter called the top part 3, is made of foamed plastic and is provided on its underside with integral downwardly extending pairs of feet 4. One of each of the feet 4 is designed to be inserted into one of the depressions 2 in order to assemble the block, the width of each foot corresponding to the width of the depressions. The bottom part of each foot is bevelled at 5 to facilitate the insertion of the foot into a depression 2. When the top part 3 is inserted into the bottom part 1, the two parts complement each other to form a light-weight, thermally insulating ceiling block.

Figure 4:
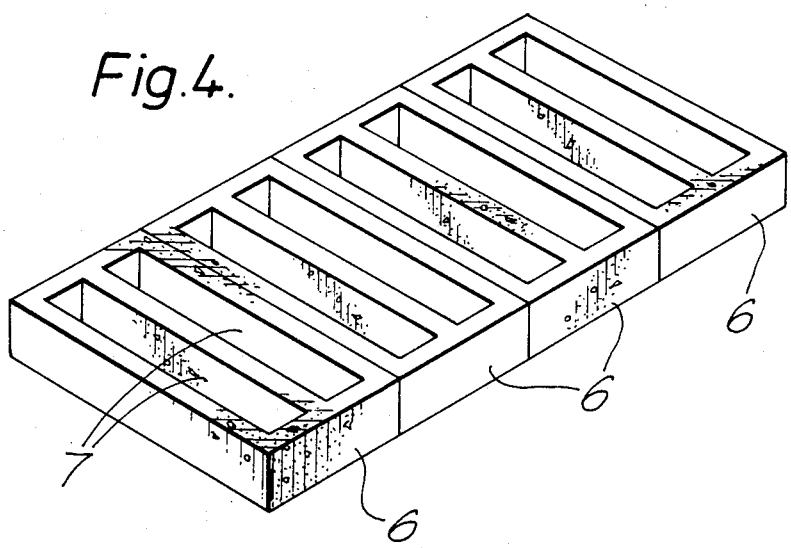

In FIG. 4 a plurality, i.e. four bottom parts 6 of concrete, light concrete. gypsum, asbestos, or the like, are juxtaposed in alignment, each of the concrete parts 6 having two adjacent depressions 7 along their top faces. The top 8 of the blocks is made of foamed plastics of a length equal to the length of the four bottom parts. Part 8 is provided with four pairs of feet 9 whose bottoms 10 are bevelled. Each pair of aligned feet are designed to be inserted into one of the depressions 7, at either of their ends, of a block part 6. A channel 11 is provided on the underside of part 8 for the disposition of electric wiring or other installations therein. If desired, channel 11 may be linked with metal or plastics during casting.

When the blocks assembled from the top and bottom part here illustrated and described, are placed on a scaffolding to form a ceiling and a layer of concrete is cast thereon, a thermally insulating, light-weight floor is obtained.

The top part 8, made of plastic foam, may be cast of any suitable length which is preferably a multiple of the width of one block part and for each width of one block part, a pair of feet are provided. These feet may be aligned in the longitudinal direction on a block part or they may be staggered, so that one foot will extend into one depression in the bottom part, and one into the other.

If desired, the bottom part may also be made of a multiple of parts 1.

Figure 5:
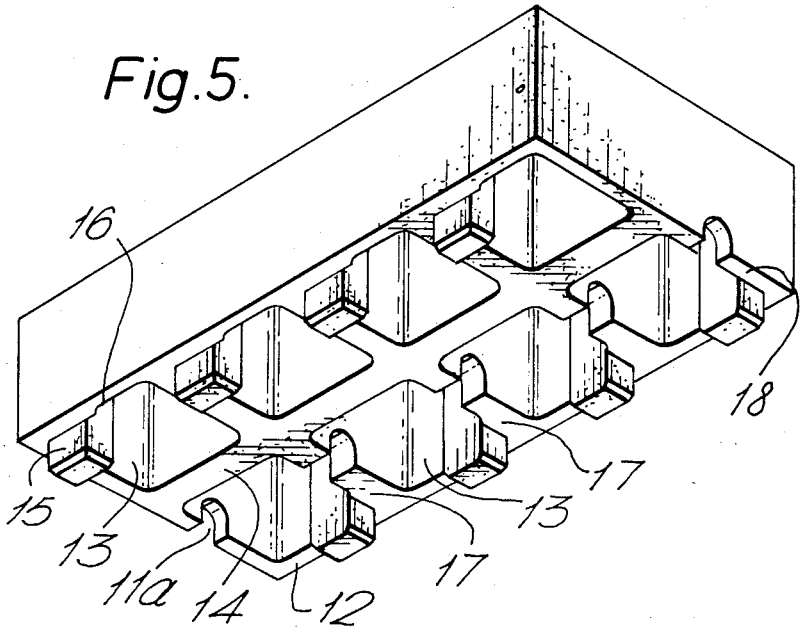
FIGS. 5 and 6 show in perspective view from below a further embodiment of the invention.
Figure 6:
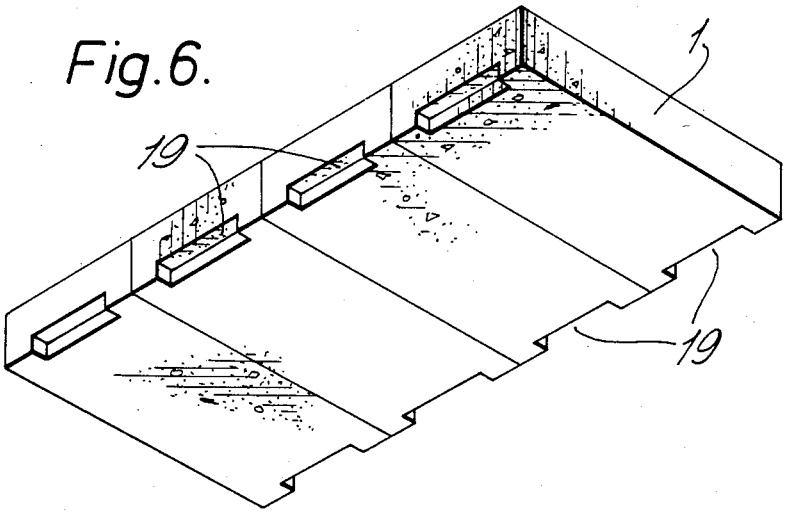

In FIGS. 5 and 6, a plurality of bottom parts which may be the construction of FIG. 2 or 4 are shown. The top part which is cast of foamed plastics is made of one integral part 12 which is constituted by a plurality, in this case four parts which may be a multiple of part 3 of FIG. 1.

In the embodiment shown in FIG. 5, each of the four attached parts has two depressions 13, the wall 14 between said depressions constituting a reinforcement of the block. In the corner of each depression an integral downwardly extending foot 15 which is bevelled on three sides, is provided, the feet of one part being staggered relative to each other. The depression is slightly cut out at 16, adjacent foot 15 and this for shipping and storing purposes, so that when one part 12 is placed onto another, the feet 15 of one will fit into the cut-out 16 of the depressions 13 of the other, thus preventing damage to said feet and minimizing the volume taken up by the parts.

It is to be understood that the walls 17 between the two block parts of the part 12 have twice the width of the end walls 18 of said part 12, so that, if desired, one or more block parts may be sawed off to meet the particular requirements. Furthermore, reinforcement ribs (not shown) of any suitable height may be provided in depressions 13. Aligned cut-out channels **11*a* are made in end walls 18 and intermediate walls 17** for the disposition therein of electrical wiring or other desired utilities.

Small cut-outs 19 are made on the bottom edges of the sides of the parts 1, i.e. the sides which face each other when two rows of adjacent blocks are placed on the scaffolding. When the concrete is poured over the top of the blocks to cast the floor, the concrete will enter these cut-outs 19 to form a solid connection.

It can be seen that with the ceiling block above described all the objects cited above are obtained. In fact, the thicker a required ceiling, its relative weight is reduced, because only the top part 3 of the block needs to be higher. Thus even with deep floors, the cost of the supporting structure of the building is much less.

I claim:

1. Ceiling block construction for an in situ assembly comprising bottom parts and top parts, said bottom parts being precast from concrete or like material, each bottom part being of a rectangular configuration with planar exterior side and end walls, each bottom part having a first dimension defined between and inclusive of the opposed planar end walls, and a second dimension defined between and inclusive of the opposed planar side walls, each bottom part also including top and bottom faces, said planar exterior walls being projection-free for the full height thereof between the top and bottom faces, a plurality of depressions formed in the top face of each bottom part inward of said planar walls and defined by planar sides forming corners therebetween, said depressions terminating inward of said bottom faces, and at least one transverse interior wall, said bottom parts being assemblable with the top faces coplanar and with selected exterior walls in wall-to-wall abutment for the full height thereof to define a continuous extent equal to the combined width and length of adjacent bottom parts, said top parts being of foamed plastic and having a rectangular configuration with planar exterior side and end walls, each top part having a first dimension defined between and inclusive of the opposed planar end walls thereof and equal to the first dimension of said bottom parts, said top part further including a second dimension defined between and inclusive of the opposed planar side walls thereof and being of a length at least equal to twice that of the second dimension of a bottom part whereby each top part overlies multiple bottom parts, each top part having a plurality of integral depending projections receivable within corners of the depressions of each underlying bottom part to preclude lateral and longitudinal movement therebetween, the projections being so oriented as to align opposed end walls of the top parts with opposed end walls of the bottom parts to define continuous planar end surfaces, said concrete bottom parts stabilizing and positioning said foamed plastic top parts.

2. The ceiling block construction of claim 1, wherein the second dimension of each top part is equal to the second dimension of four bottom parts for simultaneous overlying engagement with four bottom parts in wall-to-wall abutment with each other.

3. The ceiling block construction of claim 1 wherein said top part includes at least two depressions with an internal wall therebetween, said internal wall paralleling said side walls of the top part, said internal wall being spaced from one of these side walls a distance approximately equal to the spacing between the side walls on one of said bottom parts, said internal wall being of a thickness at least approximately twice that of the side walls of a bottom part.

4. The ceiling block of claim 3 wherein each projection is of a width substantially equal to that of the depression receiving the projection.

5. The ceiling block of claim 1 wherein each projection is of a width substantially equal to that of the depression receiving the projection.

* * * * *

UNITED STATES PATENT AND TRADEMARK OFFICE

CERTIFICATE OF CORRECTION

PATENT NO. : 4,599,839

DATED : July 15, 1986

INVENTOR(S) : Jacov Snitovski

It is certified that error appears in the above-identified patent and that said Letters Patent is hereby corrected as shown below:

Page 1, line (76), delete inventors name "Snitovski Jacov" and insert --Jacov Snitovski--;

Column 2, line 13, delete "linked" and insert --lined--; and

Column 4, line 16, delete "1" and insert --2--.

Signed and Sealed this

Seventh Day of October, 1986

[SEAL]

*Attest:*

DONALD J. QUIGG

*Attesting Officer*

*Commissioner of Patents and Trademarks*